US005116524A

United States Patent [19]

Carduck et al.

[11] Patent Number: 5,116,524

[45] Date of Patent: May 26, 1992

[54] DETERGENT PRODUCT INCLUDING A WATER-INSOLUBLE, WATER-PERMEABLE BAG MADE FORM SHEATHED BICOMPONENT FIBERS

[75] Inventors: Franz-Josef Carduck, Haan; Ulrich Jahnke, Monheim; Eduard Smulders, Hilden; Guenther Vogt, Toenisvorst; Monika Boecker, Duesseldorf; Werner Kuenzel, Langenfeld, all of Fed. Rep. of Germany

[73] Assignee: Henkel Kommanditgesellschaft auf Aktien, Duesseldorf, Fed. Rep. of Germany

[21] Appl. No.: 598,732

[22] PCT Filed: Apr. 15, 1989

[86] PCT No.: PCT/EP89/00406

§ 371 Date: Oct. 23, 1990

§ 102(e) Date: Oct. 23, 1990

[87] PCT Pub. No.: WO89/10395

PCT Pub. Date: Nov. 2, 1989

[30] Foreign Application Priority Data

Apr. 23, 1988 [DE] Fed. Rep. of Germany ..... 3813773

[51] Int. Cl.[5] ..... C11P 17/04

[52] U.S. Cl. ..... 252/90; 252/91; 252/174; 206/0.5; 428/224; 428/298; 428/375

[58] Field of Search ..... 252/90, 91, 174; 206/0.5; 428/224, 298, 375

[56] References Cited

U.S. PATENT DOCUMENTS

| | | | |
|---|---|---|---|
| 3,505,164 | 4/1970 | Oppenlander | 428/370 |
| 4,189,338 | 2/1980 | Ejima et al. | 156/167 |
| 4,555,354 | 11/1985 | Clarke et al. | 252/90 |
| 4,722,857 | 2/1988 | Tomioka et al. | 156/177 |
| 4,818,587 | 4/1989 | Ejima et al. | 428/373 |
| 4,830,904 | 5/1989 | Gessner et al. | 252/90 |
| 4,876,023 | 10/1989 | Dickenson | 252/174 |
| 4,921,622 | 5/1990 | Kato et al. | 252/8.6 |
| 5,053,270 | 10/1991 | Mack | 252/90 |

FOREIGN PATENT DOCUMENTS

| | | |
|---|---|---|
| 0011968 | 6/1980 | European Pat. Off. . |
| 0132110 | 1/1985 | European Pat. Off. . |

*Primary Examiner*—A. Lionel Clingman
*Assistant Examiner*—Bradley A. Swope
*Attorney, Agent, or Firm*—Ernest G. Szoke; Wayne C. Jaeschke; Real J. Grandmaison

[57] ABSTRACT

When used in a washing machine, a particulate detergent packed in portions in a flexible bag of a flat, water-permeable textile material leads to an improved detergency performance and/or saving of detergent by comparison with the conventional addition of detergent via the dispensing compartment of the washing machine if the bag material satisfies certain criteria in regard to the nature of the fibers used for its production and, optionally, the permeability to air and the adsorption capacity of the bag material, the geometric dimensions of the bag and its filling level.

10 Claims, No Drawings

DETERGENT PRODUCT INCLUDING A WATER-INSOLUBLE, WATER-PERMEABLE BAG MADE FORM SHEATHED BICOMPONENT FIBERS

This invention relates to a detergent product consisting of a water-insoluble, water-permeable bag containing a powder-form or granular detergent in the quantity necessary for a washing program.

Detergents preportioned in bags have been known for some time. They afford the advantage that the user does not have to measure off the quantity of detergent required for a washing program, the flow properties, particle size distribution and appearance of the detergent have to meet only minimal requirements. the user does not come into contact with the detergent and its potentially skin-irritating constituents and that the detergents accommodated in bags of water-insoluble materials are released to the liquor in dissolved or finely dispersed form so that there are none of the losses of detergent which occur when unpacked detergent is added in machines of the type which do not have a closed solution sump or in which the contents of the solution sump are not recirculated. However, if all the advantageous properties of detergents in portion bags are to be utilized, the properties of the bag have to meet various requirements. Thus, on the one hand, the bag has to be so dense that finely divided detergent constituents remain enclosed. On the other hand, however, the bag has to be so permeable to water that the detergent can be rapidly dissolved out or washed out by the washing water. The bag materials have to lend themselves to processing in typical filling and packaging machines, which above all presupposes weldability with permanently heated welding jaws. In addition, the bag materials must not be affected by the bag contents and should not be so expensive that they are not worth using. Since hitherto known detergent portion bags did not all have these necessary properties at one and the same time, detergent products of this type have never been able to command a place in the market.

Water-insoluble, water-permeable portion bags for particulate detergents are described, for example, in EP-A-11 968. The bags described therein are made of a material which consists at least partly of polypropylene fibers. However, the bag material may additionally contain cellulose fibers, polyester fibers, polyamide fibers or blends thereof. According to the teaching of the cited patent application, bag materials consisting solely of polypropylene fibers or at least substantially of polypropylene fibers are preferred. However, this material presents difficulties when it comes to making up into bags.

It has now been found that improved bag materials are eminently suitable for the described purpose.

Accordingly, the present invention relates to a detergent product containing a particulate detergent in a water-insoluble, water-permeable bag of a flat textile material of which the fibers consist of polypropylene and another organic polymeric material, the fibers consisting solely of sheathed bicomponent fibers of an inner core of polypropylene having a crystallinity determined by X-ray structure analysis of 40 to 60% which is sheathed with polyethylene having a crystallinity of 50 to 70%.

Bag materials which satisfy the above-mentioned requirements can be made from fibers such as these.

Above all, the requirement for ready weldability in standard machines having permanently heated welding jaws is satisfied by materials of these so-called bicomponent fibers. It is thus possible to produce even sealed-edge bags (flat bags) which do not normally lend themselves to impulse welding.

Particularly valuable properties in this regard are exhibited by fibers in which the polypropylene component is larger than the polyethylene component, the ratio by weight between the two components being in particular from 3:2 to 9:1. Extremely fine fibers can be produced from such materials and, accordingly, can be made up into very compact, but highly water-permeable bag materials. Suitable fibers of this type have a denier of 0.7 to 3 dTex (dTex =weight in grams of a filament 10,000 meters in length).

A suitable material in regard to impermeability to dust but permeability to water is, for example, an unwoven flat textile having a permeability to air of 200 to 600 liters per square meter and second for a pressure difference of 10 millimeters water column.

The adsorption capacity, as measured by a test which is described in U.S. Federal Specifications UU-T-595B and which was modified for the present application in accordance with DE-A-19 65 470, is in the range from 1.5 to 7 and more particularly of the order of 5.

The tenacity of materials of the type in question both in the dry state and in the wet state is in the range from about 50 to about 70 newtons (as measured in the longitudinal direction). One such material is marketed, for example, by Ch. H. Sandler, Schwarzenbach/Saale, under the name Sawabond VP 59/85/207. This bag material has a weight per unit area of approximately 40 to 60 grams per square meter. Bags made from this material with an edge length of 5 to 20 and preferably 8 to 15 centimeters for a surface area of 30 to 300 and preferably 60 to 200 square centimeters (as measured on one side) are capable of accommodating a particulate detergent, including both finely powdered and coarse-particle detergents, in a quantity sufficient for a washing program. Depending on the type and liter weight of the detergent, suitable bags—which are welded either on three or on four sides after filling—contain approximately 20 to 120 grams detergent.

To ensure that the contents of the bag dissolve to a sufficient degree, it is important to ensure that the bag is filled to about 40 to 75% of its volume. The degree of dissolution is determined by introducing a bag filled with detergent into an automatic washing machine together with the required load of fabrics, starting the machine on the normal program, removing the bag 10 minutes after the start of the washing program and relating the residue in the bag to the amount of detergent weighed in. A high degree of dissolution is achieved if, under these conditions, at least 80% by weight of the amount of detergent weighed in has dissolved after 10 minutes.

Since none of the detergent can accumulate in undissolved or undispersed form in the sump of the washing machine where these preportioned detergent bags are used, the saving of detergent through better utilization is around 20 to 30% compared with the normal procedure where the detergent is washed in at the beginning of the washing program. On the other hand, better washing results can be obtained with the detergent products according to the invention—for the same quantity by weight of detergent—than if the same detergent is washed into the washing machine with the washing water at the beginning of the washing process. The flat textile material can be improved in its stability by mechanical stabilization of the surface through thermal consolidation so that the fibers used in its production are fixed in position within the flat material.

The detergent bag may have one or even several compartments. Where the bag has several compartments, the compartments may accommodate different detergent constituents which are incompatible or poorly compatible with one another. If all four or three edges of such a bag are firmly welded, the bag or rather its compartments do not open during the washing process. However, one or even several weld seams may be made weak or may be weakened by special measures, for example by insertion of a separation layer, so that the bag or the compartment opens during the washing process and releases its contents to the wash liquor. In a preferred embodiment, however, the bag is firmly welded and only releases its contents through the fine pores of the bag material.

The bag may contain any particulate detergent. The particle size distribution of the detergent may vary over a wide range, for example from 0.01 to 3 millimeters. Where detergents of high specific gravity are used, it is logical to use correspondingly small bags. On the other hand, however, the size of the bag must not be below a certain lower limit because otherwise the bag might be removed from the fabrics to be circulated during the washing process and might settle in a dead angle of the washing machine, for example at the filling opening. As mentioned above, therefore, suitable bags have a minimum edge length of about 5 centimeters for a surface area of 30 to 300 square centimeters (as measured on one side). The bags preferably have a thickness of 10 millimeters and, more particularly, 15 millimeters at at least one point.

The present invention also relates to the use of a flat textile material as described above as a bag material for a detergent product of the type mentioned. The detergent-containing bags may be made individually or in lines of several. In that case, the user can detach and use one or more bags, depending on the amount of detergent required. Instead of particulate detergents, paste-form detergents may also be packed in the bags. In that case, it is best to seal the bag material on the inside and/or outside with a water-soluble or removable coating.

The described detergent product represents a convenient and reliable possibility for dosing detergents. Compared with detergents that are not packed in portion bags, the particulate detergent thus packed has to meet only minimal requirements in regard to particle size distribution, flow properties and appearance. The user does not come into contact with the actual detergent, which is particularly important for users with an allergic reaction to detergent constituents. Since the detergent cannot be removed from the washing process by settling in the solution sump of the washing machine, a considerable saving of detergent and correspondingly reduced wastewater pollution are obtained for an excellent washing result. Dust-fine constituents of the detergent remain enclosed in the bag pending use while coarse detergent particles are reliably dissolved or washed out.

EXAMPLES

EXAMPLE 1

This Example demonstrates the superior detergency performance of the detergent product according to the invention compared with the conventional addition of the same detergent in the same quantity by weight, the particulate detergent being washed by the washing water into the washing drum from the dispensing compartment of an automatic domestic machine (Miele W 433) at the beginning of the washing process.

An all-purpose detergent having the following composition was used:

| | |
|---|---|
| 7% | by weight Na alkyl benzene sulfonate |
| 4% | by weight fatty alcohol mixture, ethoxylated |
| 1% | by weight soap |
| 1% | by weight cellulose ether |
| 7% | by weight soda |
| 3.5% | by weight waterglass |
| 22% | by weight Na perborate (tetrahydrate)/activator |
| 25% | by weight zeolite A |
| 4% | by weight polycarboxylate |
| 0.5% | by weight enzyme |
| 12% | by weight sulfate |

remainder water, fragrances, dyes, optical brighteners, complexing agents, foam inhibitors, salts in small quantities.

95% of the particles were between 0.1 and 1.6 millimeters in size.

This detergent was packed in bags of two square pieces —heat-sealed along all four edges—of a nonwoven having the following characteristic data:

| | |
|---|---|
| Edge length (without weld seams): | 10.5 centimeters |
| Content: | 70 grams |
| Fiber material: | bicomponent fiber |
| core: | polypropylene, crystallinity 48% |
| sheath: | polyethylene, crystallinity 57% |
| denier: | 1.5-1.7 dTex |
| fiber length: | 38 millimeters |
| Weight per unit area: | 50 grams per square meter |
| Production: | dry process, heat-consolidated |
| Tenacity: longitudinal: | dry: 55 newtons<br>wet: 62 newtons |
| Adsorption capacity: | 5 |
| Air permeability: | 300 liters per square meter and second for a pressure difference of 100 millmeters water column |
| Manufacturer: | Ch. H. Sandler, Schwarzenbach/Saale |

Using quantities of 140 grams of each detergent (without bag=test A; in two bags=test b), artificially soiled test fabrics were washed together with 3.5 kg clean ballast fabrics in a one-wash cycle at 60° C. The water hardness was 14°d (d=German hardness) and the quantity of water 21 liters. Detergency performance was determined by remission measurement at 460 nanometers. The results shown in Table 1 below were obtained;

TABLE 1

| Soil | Remission values (%) A (= comparison) | B (= invention) |
|---|---|---|
| Grease/pigment (average value from 4 different stains) | 62.0 | 68.1 |
| Bleachable (average value | 63.1 | 64.6 |

TABLE 1-continued

| Soil | Remission values (%) A (= comparison) | B (= invention) |
|---|---|---|
| from 5 different stains) | | |
| Protein (average value from 4 different stains) | 65.7 | 69.3 |

Irrespective of the soil type, a distinctly better washing result is obtained when the detergent is used in bags of material having carefully balanced properties than when the detergent is added in the same quantity via the dispensing compartment of the washing machine.

What is claimed is:

1. A detergent product containing a particulate detergent composition in a water-insoluble, water-permeable bag, said bag being constructed from a sheet-form textile material wherein the fibers thereof consist of sheathed bicomponent fibers consisting of an inner core of polypropylene having a crystallinity of about 40 to about 60 percent and a sheath of polyethylene having a crystallinity of about 50 to about 70 percent, said crystallinity values having been determined by x-ray analysis, said fibers having a denier of about 0.7 to about 3 dTex, said textile material having a permeability to air of about 200 to about 600 liters per square meter and second for a pressure difference of about 10 millimeters water column, an absorption capacity of about 1.5 to about 7, and a tenacity of from about 50 to about 70 newtons as measured in the longitudinal direction.

2. A detergent product as in claim 1 wherein said polypropylene and said polyethylene are present in a ratio by weight of from about 3:2 to about 9:1, respectively.

3. A detergent product as in claim 1 wherein said bag has an edge length of from about 5 to about 20 centimeters and a surface area of about 30 to about 300 square centimeters as measured on one side.

4. A detergent product as in claim 1 wherein said bag is filled to between about 40 and about 75 percent of its volume.

5. A detergent product as in claim 1 wherein said bag has heat-sealed edges and releases its contents through pores in said textile material.

6. The process of washing laundry in a washing machine containing soiled laundry, comprising adding thereto a detergent composition in a water-insoluble, water-permeable bag, said bag being constructed from a sheet-form textile material wherein the fibers thereof consist of sheathed bicomponent fibers consisting of an inner core of polypropylene having a crystallinity of about 40 to about αpercent and a sheath of polyethylene having a crystallinity of about 50 to about 70 percent, said crystallinity values having been determined by x-ray analysis, said fibers having a denier of about 0.7 to about 3 dTEx, said textile material having a permeability to air of about 200 to about 600 liters per square meter and second for a pressure difference of about 10 millimeters water column, an absorption capacity of about 1.5 to about 7, and a tenacity of from about 50 to about 70 newtons as measure din the longitudinal direction.

7. The process as in claim 6 wherein said polypropylene and said polyethylene are present in a ratio by weight of from about 3:2 to about 9:1, respectively.

8. The process as in claim 6 wherein said bag has an edge length of from about 5 to about 20 centimeters and a surface area of about 30 to about 300 square centimeters as measured on one side.

9. The process as in claim 6 wherein said bag is filled to between about 40 and about 75 percent of its volume.

10. The process as in claim 6 wherein said bag has heat-sealed edges and releases its contents through pores in said textile material.

* * * * *

UNITED STATES PATENT AND TRADEMARK OFFICE

CERTIFICATE OF CORRECTION

PATENT NO. : 5,116,524

DATED : May 26, 1992

INVENTOR(S) : Carduck et al.

It is certified that error appears in the above-indentified patent and that said Letters Patent is hereby corrected as shown below:

In claim 6, column 6, line 16, "40 to about " should read --40 to about 60--.

Signed and Sealed this

Twelfth Day of October, 1993

*Attest:*

*Attesting Officer*

BRUCE LEHMAN

*Commissioner of Patents and Trademarks*